United States Patent [19]

Fyfe et al.

[11] Patent Number: 4,605,106

[45] Date of Patent: Aug. 12, 1986

[54] DISPLACEMENT CONTROL DEVICE

[75] Inventors: Edward R. Fyfe, Burlington; William M. Slater, Toronto, both of Canada

[73] Assignee: Elastometal Limited, Ontario, Canada

[21] Appl. No.: 571,268

[22] Filed: Jan. 16, 1984

[30] Foreign Application Priority Data

Jan. 17, 1983 [CA] Canada ..... 419576

[51] Int. Cl.[4] ..... E02D 27/34

[52] U.S. Cl. ..... 188/374; 52/167; 188/268; 188/377; 14/16.1

[58] Field of Search ..... 52/167; 14/16.1; 188/374, 377, 268

[56] References Cited

U.S. PATENT DOCUMENTS

| | | | |
|---|---|---|---|
| 3,380,557 | 4/1968 | Peterson | 188/374 |
| 3,606,704 | 9/1971 | Denton | 52/167 |
| 3,638,377 | 2/1972 | Caspe . | |
| 3,806,975 | 4/1974 | Fyfe . | |
| 3,865,415 | 2/1975 | Saxl | 188/374 |
| 3,921,240 | 11/1975 | Fyfe . | |
| 4,166,344 | 9/1979 | Ikonomou . | |
| 4,269,011 | 5/1981 | Ikonomou . | |

FOREIGN PATENT DOCUMENTS

| | | | |
|---|---|---|---|
| 901031 | 5/1972 | Canada | 52/167 |
| 2351871 | 4/1974 | Fed. Rep. of Germany | 188/374 |
| 2649891 | 5/1978 | Fed. Rep. of Germany | 188/374 |
| 2149759 | 1/1979 | Fed. Rep. of Germany | 188/374 |
| 678223 | 8/1979 | U.S.S.R. | 188/377 |

*Primary Examiner*—Henry E. Raduazo

*Attorney, Agent, or Firm*—Pollock, Vande Sande & Priddy

[57] ABSTRACT

A displacement control device for damping relative movement between a structure and a support for the structure, and for absorbing energy when the relative movement exceeds a predetermined amount.

3 Claims, 6 Drawing Figures

DISPLACEMENT CONTROL DEVICE

This invention relates to a displacement control device for use with an aseismic (resistant to earthquake) bearing to damp relative movement between building or bridge superstructure and foundation or supports and absorb energy when the relative movement exceeds a predetermined amount.

BACKGROUND OF THE INVENTION

It is known to design building structures including multi-story building structures with modified foundations designed to isolate the building's superstructure from major ground motion during an earthquake. Essentially, in this prior art the superstructure is supported by its foundation so that during an earthquake relative, primarily horizontal, displacement is permitted between the foundation and the superstructure so that the high horizontal forces encountered during an earthquake will not be transferred to the superstructure in an amount sufficient to cause irreparable damage to, or destruction of, the superstructure.

Structures utilized to achieve this result include the apparatus disclosed in U.S. Pat. No. 3,638,377 dated Feb. 1st, 1972 to M. S. Caspe, U.S. Pat. No. 4,166,344 issued Sept. 4th, 1979 to A. S. Ikonomou, and U.S. Pat. No. 4,269,011 issued May 26th, 1981 to Ikonomou.

All of this known prior art is concerned in particular with building structures and teaches specific means for avoiding the translation to that structure of high seismic forces which if transmitted to the structure would be adequate to severely damage or destroy the structure, with serious consequences.

Bridge structures, as well as building structures which are located in an earthquake zone, are capable of being damaged or destroyed by seismic forces, often with serious consequences. In general bridge structures, due to their nature, are constructed with bearings to both support and guide it, located between the bridge's deck or superstructure and the bridge supporting piers or foundations to permit relative movement between the two which movement occurs primarily as a result of dimensional changes in a longitudinal direction in the bridge deck caused by temperature changes, creep, shrinkage, earth and other movements. There are many known bearings utilized to permit movement of a bridge deck relative to its supporting structure. These bearings, as is well known, can take many different forms and include sliding plate bearings, pot bearings, rotatable spherical and cylindrical bearings and high load structural bearings. They can be fixed, multidirectional or unidirectional bearings. If fixed, guide bearings must also be provided. Normally, both the supporting and guiding is accommodated by one bearing. U.S. Pat. Nos. 3,921,240 and 3,806,975 exemplify some of these known bearings.

It is also known to provide damping for the movement upon these bearings of superstructure relative to supports, however the permitted relative movement is not large and furthermore it is not always preferred to attempt to hold a superstructure in a position around a neutral point with respect to the supports.

It would be highly desirable to provide those bridges located in earthquake zones with bearing structures which function to accommodate both the normal support and/or guiding function, and when necessary, seismic forces resulting from an earthquake. In particular it would be advantageous to have an aseismic bridge bearing structure which includes means for reducing to an acceptable extent the horizontal seismic forces transmitted to a bridge superstructure during an earthquake to thereby prevent damage to the bridge superstructure, or at least reduce damage, to the degree necessary to permit the bridge to remain relatively intact during the earthquake, and permit it to be readily repaired after the earthquake.

SUMMARY OF THE INVENTION

The present invention provides a displacement control device for a building or bridge bearing structure capable of significantly reducing the seismic forces which would, without such a device be liable to be transmitted to a building or a bridge superstructure during an earthquake in which there are relatively large displacements involved. Specifically, in accordance with the present invention, there is provided a displacement control device which can dampen the displacement up to a predetermined amount and thereafter can absorb the energy of further displacement.

Broadly, the displacement control device therefore limits the magnitude of movement between two relatively moveable bodies and comprises a first member and a second member, means for securing each of said members to a different one of said bodies, the first member including a shaft, viscoelastic discs slidably mounted on the shaft, the second member being cylindrical and being slidably moveable relative to the first member with movement in one direction relative to said first member compressing at least some of said discs and a perforated disc secured within the second member and having a viscous material between at least one side of the disc and an end support for the discs, such that further displacement not controllable by compression of the discs is absorbed by extrusion of the viscous material through the perforations of the disc.

DESCRIPTION OF THE PREFERRED EMBODIMENTS

Figure 1:
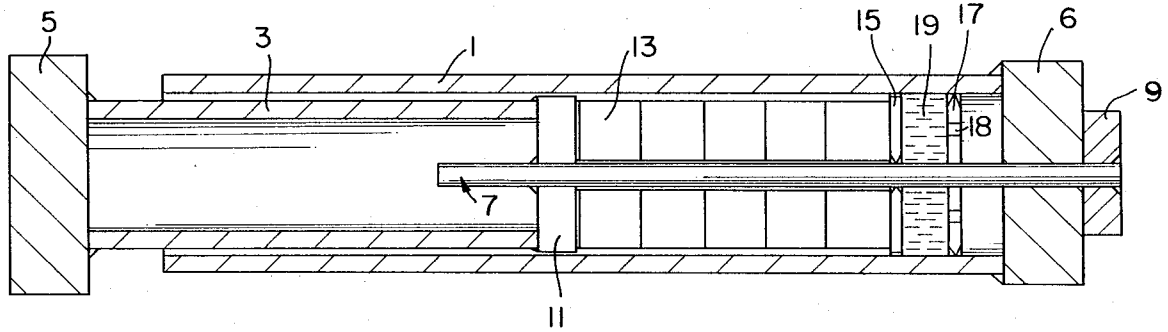
FIG. 1 is a cross sectional view of a single acting displacement control device constructed in accordance with the present invention.

Referring to FIG. 1, the displacement control device consists, in its simplest form, of an outer cylinder 1, an inner cylinder 3 and end caps 5 and 6 welded to the cylinders. The cylinders and end caps are preferably made from a high tensile steel. A rod 7 passes through end cap 6 and has a plate 9 welded to its outer end and a round plate 11 welded near to its other end, the plate (solid disc) 11 being a sliding fit inside cylinder 1. A number of viscoelastic discs 13 are positioned between plate 11 and a plate (solid disc) 15 which is slidable around rod 7 and within cylinder 1. A perforated plate 17, having perforations 18, is welded within cylinder 1 and between the normal position of plate 15 and the end cap 6, and a viscous material such as lead is positioned between movable plate 15 and fixed plate 17.

This single acting displacement control device is built into a structure, such as a bridge structure, so that one of end caps 5 and 6 is securely attached to a bridge support while the other end cap is in contact with the bridge superstructure or with a known aseismic bearing upon which the superstructure is supported.

During earthquake activation when one end cap is moved closer to the other, the viscoelastic discs 13 are first compressed to damp relative movement and thereafter during excessive movement the viscous material is extruded through perforations 18 to absorb energy.

Figure 2:
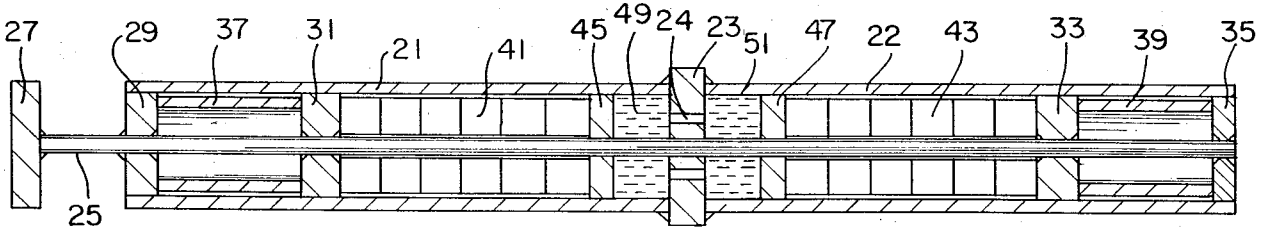
FIG. 2 is a cross sectional view of a double acting displacement control device constructed in accordance with this invention.

FIG. 2 discloses a double acting displacement control device having two outer cylinder tubes 21 and 22 welded to a flat cylindrical perforated plate 23, having perforations 24, and a rod 25 slidably accommodated through a central bore in the plate 23. To the rod 25 there is welded a plate 27 for transmitting load to the rod 25, and circular plates 29, 31, 33 and 35, these latter plates being slidable within cylinders 21 and 22 respectively. Spacer cylinders 37 and 39 are positioned respectively between plates 29, 31 and plates 33 and 35. A number of viscoelastic discs 41 and 43 are positioned between the plates (solid discs) 31, 33 respectively and slidable plates (solid discs) 45 and 47. A viscous material 49 and 51 fills the spaces on either side of plate 23 up to plates 45 and 47.

During operation, the double acting displacement control device is secured between a fixed support and a movable superstructure of a bridge, the plate 27 cooperating with the movable superstructure either directly or indirectly through an aseismic bearing, and during movement between the structure and the superstructure in either direction, the viscoelastic discs 41 or 43 will first control relative movement by deforming discs 41 or 43, and thereafter, during excessive relative movement plate 45 or 47 is moved and extrudes the viscous material 49 or 51 through the perforations 24 in plate 23 so absorbing the excess energy.

Figure 3:
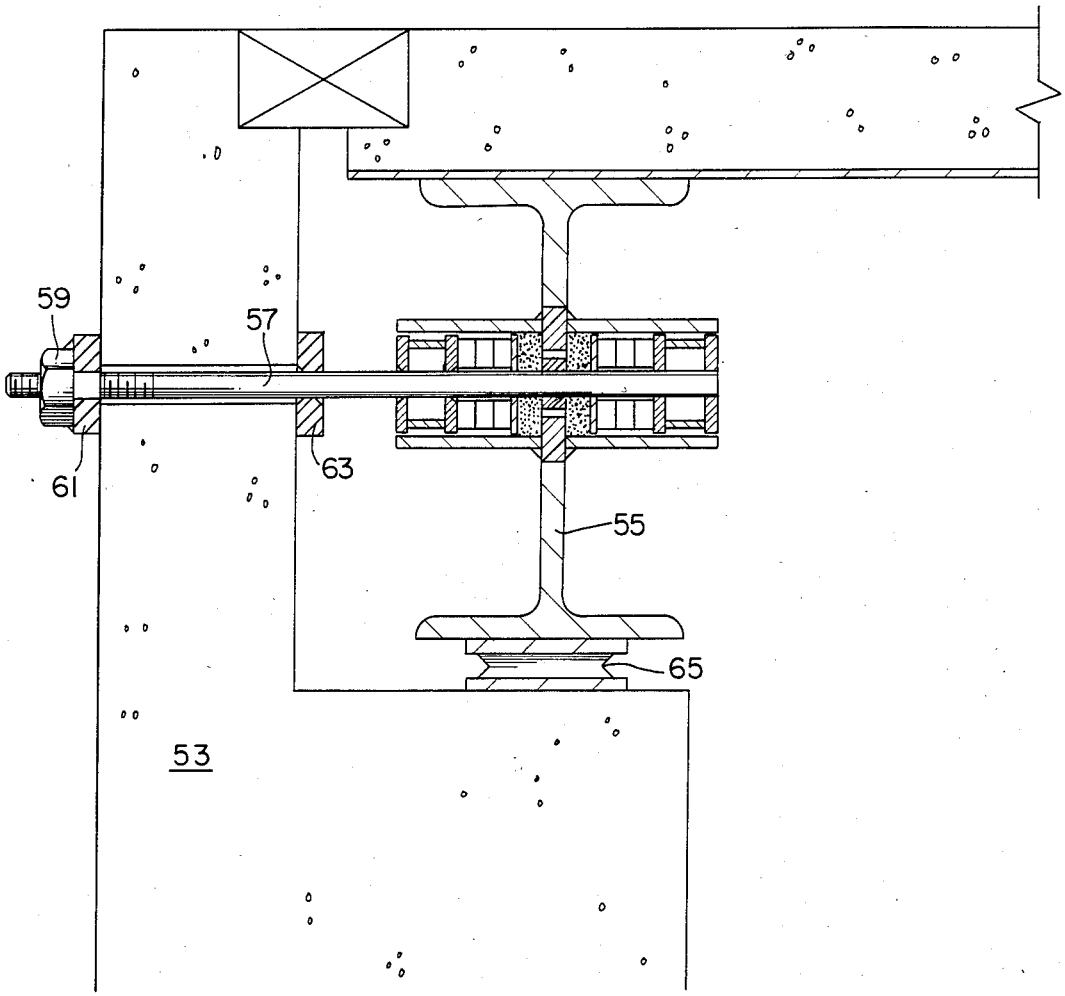
FIG. 3 is a cross sectional view of a double acting displacement control device constructed in accordance with this invention and installed between a concrete bridge support and a steel bridge structure.

In FIG. 3 there is shown a double acting displacement control device of the type shown in FIG. 2 secured between a bridge support 53 and a steel bridge superstructure 55. The rod 57 through the displacement control device is extended from one side of the device and is threaded at the outer end to accept a nut 59 which is used to clamp rod 57 to support 53 between two plates 61 and 63. The displacement control device is fitted through an aperture in the web of a steel beam forming part of the superstructure 55 and the superstructure itself is supported upon a resilient bearing 65.

Figure 4:
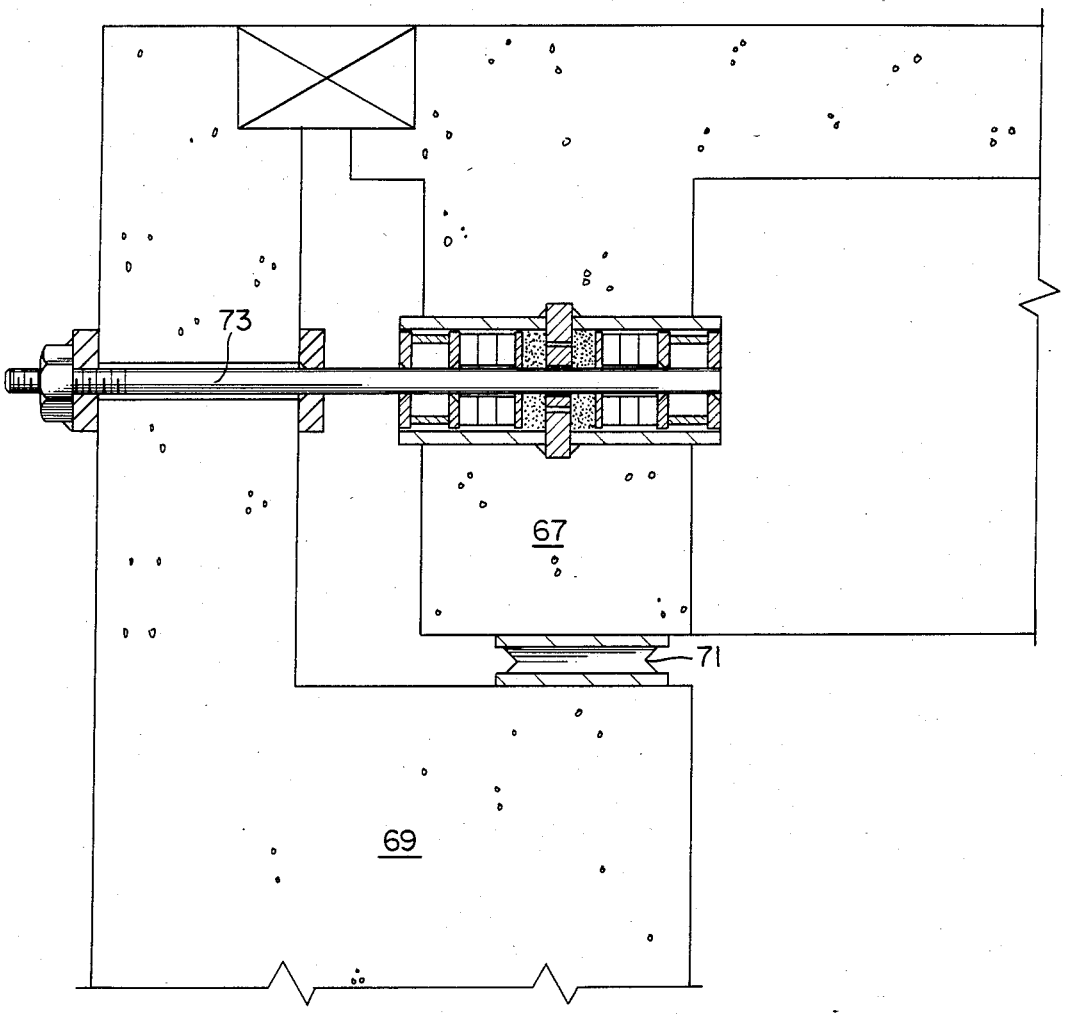
FIG. 4 is a cross sectional view of a double acting displacement control device between a concrete bridge support and a concrete bridge.

In FIG. 4, there is shown a displacement control device of the type shown in FIG. 3 but fitted into a bridge structure utilizing concrete superstructure, with the device itself being embedded within the concrete superstructure. Note that the concrete superstructure 67 is again supported upon bridge support 69 through a resilient bearing 71 with the displacement control device being almost completely embedded in concrete superstructure 67 while the operating rod 73 is secured to support 69 in a manner identical to the support utilized in FIG. 3.

Figure 5:
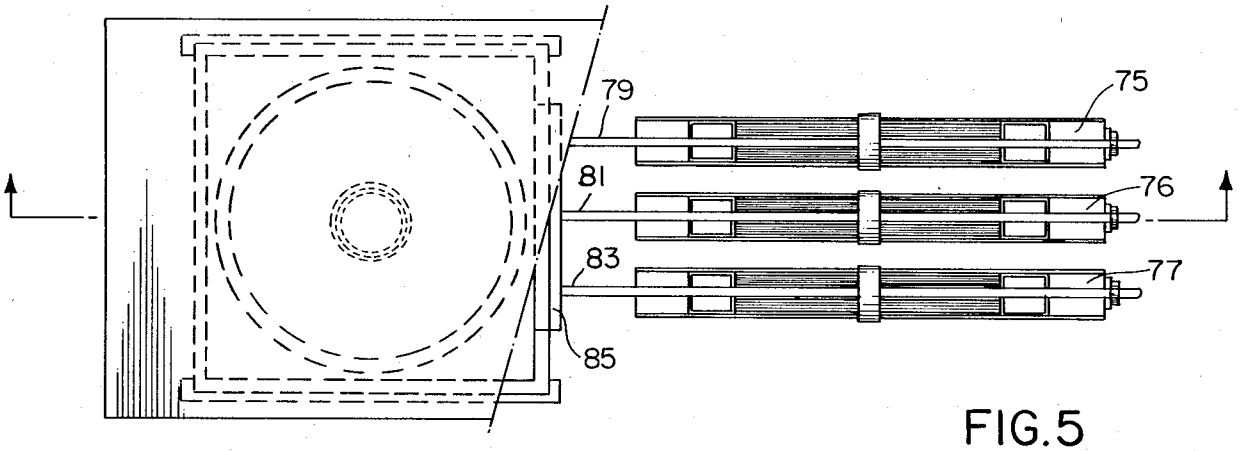
FIGS. 5 and 6 are a plan and a cross sectional view respectively showing three doubling acting displacement control devices secured to an aseismic bridge bearing of known type.
Figure 6:
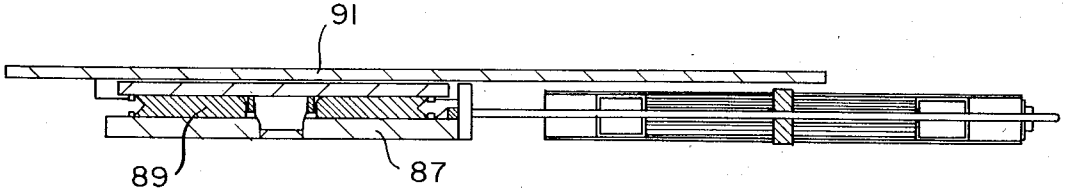

In FIGS. 5 and 6 there is shown a structure utilizing three double acting displacement control devices 75, 76 and 77 which are supported in a fixed manner (not shown) upon a bridge support and the respective operating rods 79, 81 and 83 are welded to a common plate 85 which is secured to the bottom plate 87 of an aseismic flexible bearing 89 which supports the bridge superstructure, part of which is shown by plate 91. Upon excessive movement of the flexible bearing 89, the plate 85 then moves under controlled through the devices 75, 76 and 77.

There has thus been disclosed displacement control devices which control the movement between a superstructure and a bridge support, permitting small movement under the effects of various atmospheric conditions and also controlling the maximum relative displacement during an earthquake. It will be appreciated that preferred displacement control devices have been disclosed, and in association with bridge structure, however these devices are capable of modification without departing from the scope of the present invention, these modifications being for the purpose of accommodating specific requirements of the various types of bridge structures and other building structures which are to be protected from seismic forces.

We claim:

1. A displacement control device for limiting the magnitude of movement between two relatively movable bodies comprising:

a first member for securement to one body and a second member for securement to the other body, the first member including a cylinder having located therein a plurality of viscoelastic discs arranged on a common axis, constituting a set of discs having first and second ends;

first and second solid discs located at first and second ends of said set of viscoelastic discs respectively, a perforated plate located below said second solid disc and fixed to said cylinder and a viscous material disposed between said perforated plate and said second disc; wherein upon pressure being exerted upon said first disc, the viscoelastic discs compress and limit relative movement between said first member and said second member, and upon excess movement of said first disc toward said second disc due to an increase of pressure exerted upon said first disc, said second disc is moved toward said perforted plate and extrudes the viscous material through the perforation in said perforated plate thereby absorbing some of the energy causing the relative movement.

2. A device according to claim 1, wherein each viscoelastic disc has a central aperture through which a rod extends.

3. A displacement control device for limiting the magnitude of movement between two relatively movable bodies wherein said first member includes two cylinders with said perforated plate located at the juncture of said cylinder, each cylinder including the same arrangement of discs, the second member constituting a rod extending through the cylinders and wherein at one end, said one solid disc at each outer end of the viscoelastic discs is welded to said rod, wherein each viscoelastic disc has a central aperture through which a rod extends and wherein a displacement control device for limiting the magnitude of movement between two relatively movable bodies comprising a first member for securement to one body and a second member for securement to the other body, the first member including a cylinder having located therein a plurality of viscoelastic discs arranged on a common axis, constituting a set of discs having first and second ends; first and second solid discs located at first and second ends of said set of viscoelastic discs respectively, a perforated plate located below said second solid disc and a viscous material disposed between said perforated plate and said second disc; wherein upon pressure being exerted upon said first disc, the viscoelastic discs compress and limit relative movement between said first member and said second member, and upon excess movement of said first disc toward said second disc, said second disc is moved and extrudes the viscous material through the perforations in said perforated plate thereby absorbing some of the energy causing the relative movement.

* * * * *